US005564566A

United States Patent [19]

Lamb

[11] Patent Number: 5,564,566

[45] Date of Patent: Oct. 15, 1996

[54] OUTDOOR FAUCET ORGANIZING BASKET

[76] Inventor: Steven E. Lamb, 6201 Hallet, Shawnee, Kans. 66216

[21] Appl. No.: 452,889

[22] Filed: May 30, 1995

[51] Int. Cl.[6] ..... B65D 85/00

[52] U.S. Cl. ..... 206/373; 206/372; 206/349; 211/70.6; 211/113; 248/212; 248/318

[58] Field of Search ..... 206/372, 373, 206/374, 375, 349; 211/70.6, 60.1, 113, 119; 248/79, 89, 318, 212

[56] References Cited

U.S. PATENT DOCUMENTS

| | | | |
|---|---|---|---|
| 686,954 | 11/1901 | Riley | 220/476 X |
| 809,568 | 1/1906 | Hurlburt | 220/485 |
| 896,276 | 8/1908 | Connolly | 220/481 X |
| 1,733,868 | 10/1929 | Durell | 211/70.6 |
| 1,953,037 | 3/1934 | Ash | 220/476 X |
| 3,759,597 | 9/1973 | Johnston | 206/459.5 |
| 3,878,939 | 4/1975 | Wilcox | 206/373 |
| 4,170,392 | 10/1979 | Spevak | 206/373 |
| 4,211,455 | 7/1980 | Tedrow | 206/373 X |
| 4,316,545 | 2/1982 | Hortnell | 211/70.6 |
| 4,460,085 | 7/1984 | Jentzen | 206/349 |
| 4,561,547 | 12/1985 | Estwanik, III | 211/60.1 X |
| 4,867,332 | 9/1989 | Mains | 206/372 X |
| 4,869,385 | 9/1989 | Blinsinger | 248/318 X |
| 5,005,710 | 4/1991 | Hofer | 211/70.6 |
| 5,174,447 | 12/1992 | Fleming | 206/373 |
| 5,186,329 | 2/1993 | Fogelberg | 206/372 |
| 5,350,071 | 9/1994 | Pond | 211/70.6 |

*Primary Examiner*—Paul T. Sewell
*Assistant Examiner*—Tara L. Laster

[57] ABSTRACT

An outdoor faucet organizing basket including a container having a rectangular bottom wall with a border piece coupled thereto and extended upwards therefrom to create a hollow interior, the bottom wall having a front edge, a rear edge, a pair of opposed side edges and an arrangement of spaced circular through holes formed thereon near the front edge, and the border piece including an upstanding short front wall coupled the bottom wall at a location adjacent to the through holes, an upstanding tall rear wall coupled to the bottom wall at a location adjacent to its rear edge, a pair of opposed parallel spaced upstanding side walls coupled to the bottom wall near its side edges, and a sequence of slots formed on each wall for allowing the interior to be ventilated; coupling means for coupling the container to a nozzle of an outdoor faucet; a hose clamp for holding a hose coupled one of the side walls of the container; and a plurality of hooks coupling to the container for holding miscellaneous outdoor gardening tools.

3 Claims, 3 Drawing Sheets

OUTDOOR FAUCET ORGANIZING BASKET

BACKGROUND OF THE INVENTION

1. Field of the Invention

The present invention relates to an outdoor faucet organizing basket and more particularly pertains to holding miscellaneous outdoor gardening tools at a location for their ready use with an outdoor faucet organizing basket.

2. Description of the Prior Art

The use of tool racks is known in the prior art. More specifically, tool racks heretofore devised and utilized for the purpose of holding tools and supplies are known to consist basically of familiar, expected and obvious structural configurations, notwithstanding the myriad of designs encompassed by the crowded prior art which have been developed for the fulfillment of countless objectives and requirements.

By way of example, U.S. Pat. Design No. 243,488 to Linse discloses a combination faucet extender and garden hose rack. U.S. Pat. Design No. 305,589 to Timmons discloses a combined soap dispensing and article storage rack for use in a shower. U.S. Pat. Design No. 322,746 to Saffano discloses a garden hose rack. U.S. Pat. Design No. 335,232 to Whitlock discloses a shower items rack. U.S. Pat. No. 5,137,156 to Riczinger et al. discloses a hose and tool rack. U.S. Pat. No. 5,181,621 to Plaehn discloses a tub-shower header-bar accessory-rack with universal-brackets.

While these devices fulfill their respective, particular objective and requirements, the aforementioned patents do not describe an outdoor faucet organizing basket that allows gardening tools and an end of a hose to be held at a location proximal to an outdoor faucet for their ready access and use.

In this respect, the outdoor faucet organizing basket according to the present invention substantially departs from the conventional concepts and designs of the prior art, and in doing so provides an apparatus primarily developed for the purpose of holding miscellaneous outdoor gardening tools at a location for their ready use.

Therefore, it can be appreciated that there exists a continuing need for new and improved outdoor faucet organizing basket which can be used for holding miscellaneous outdoor gardening tools at a location for their ready use. In this regard, the present invention substantially fulfills this need.

SUMMARY OF THE INVENTION

In the view of the foregoing disadvantages inherent in the known types of tool racks now present in the prior art, the present invention provides an improved outdoor faucet organizing basket. As such, the general purpose of the present invention, which will be described subsequently in greater detail, is to provide a new and improved outdoor faucet organizing basket and method which has all the advantages of the prior art and none of the disadvantages.

To attain this, the present invention essentially comprises, in combination, a container having a generally planar rectangular horizontal bottom wall with a border piece coupled thereto and extended upwards therefrom to create a hollow interior with a generally rectangular vertical cross section. The bottom wall of the container has a planar top surface, a planar bottom surface, and a periphery interconnecting the surfaces formed of a front edge, a rear edge, and a pair of opposed side edges interconnected between the edges to create a pair of squared-off rear corners and a pair of rounded front corners. The bottom wall further has an arrangement of four spaced and circular through holes formed thereon and with each through hole centrally aligned about a horizontal axis passing through the arrangement and with the horizontal axis positioned in perpendicular alignment with the front edge.

The border piece of the container includes a vertically positioned short front wall coupled to the bottom wall at a location adjacent to and inwardly offset from the arrangement of through holes and with an upper extent of the front wall terminated at a horizontal top edge, a vertically positioned tall rear wall coupled to the bottom wall at a location adjacent to its rear edge and with an upper extent of the rear wall terminated at a horizontal top edge, and a pair of opposed parallel spaced vertically positioned side walls extended between and coupled to the front wall and the rear wall and with each side wall further coupled to the bottom wall at a location adjacent to one of its side edges. An upper extent of each side wall is terminated at a top edge having a lower curved front edge portion connected with the front edge of the front wall, an upper horizontal rear edge portion connected with the top edge of the rear wall, and an angled intermediate portion interconnecting the front and rear edge portions. The border piece of the container further includes a sequence of vertically positioned rectangular slots formed thereon for allowing the interior to be ventilated and drained. The border piece of the container also includes a pair of eyelets coupled to and extended downwards from the bottom wall of the container and a pair of spaced through holes disposed on the upper extent of the rear wall of the container. Each eyelet and through hole has a size for receiving a fastener for securing the container to a generally vertical exterior surface.

A generally inverted V-shaped bracket is included. The bracket has a central ring portion offset above a midpoint of the top edge of the rear wall of the container. The ring portion is formed of pair of opposed flat pieces with a loop extended therebetween. The loop is disposable about a nozzle of an outdoor faucet. The bracket further has a first leg extended angularly downwards from one of the pieces of the ring portion and coupled to the upper extent of one of the side walls of the border piece at a location near the rear wall and a second leg extended angularly downwards from the other piece of the ring portion and coupled to the upper extent of the other side wall of the container at a location near the rear wall. A tightenable fastener is extended through the pieces of the ring portion for clamping the pieces together to secure the loop to the nozzle of the faucet.

A hose clamp is provided for holding a hose at a location proximal to the container. The hose clamp is coupled to one of the side walls of the container at a location adjacent to the rear wall. The clamp is formed of a pair of opposed spaced elongated gripping members. Each griping member has a pair of outer bends formed thereon with an inner bend formed therebetween.

A plurality of hooks is provided for holding miscellaneous outdoor gardening tools. A first set of two aligned and spaced hooks are coupled to and extended outwards from the same side wall of the container as the hose clamp at a location near the front edge portion thereof. A second set of four aligned and spaced hooks are coupled to and extended outwards from the other side wall at a location near the top edge thereof. A third set of three aligned and spaced hooks are coupled to and extended downwards from the bottom wall at a location near the front edge thereof. In addition, a fourth set of three aligned and spaced hooks are coupled to and extended downwards from the bottom wall at a location near the rear edge thereof. Lastly, a rectangular planar name plate is coupled to the front wall and bears identifying indicia. The outdoor faucet organizing basket is formed of a molded plastic or a rigid metal that is coated with plastic.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved outdoor faucet organizing basket which has all the advantages of the prior art tool racks and none of the disadvantages.

It is another object of the present invention to provide a new and improved outdoor faucet organizing basket which may be easily and efficiently manufactured and marketed.

It is a further object of the present invention to provide a new and improved outdoor faucet organizing basket which is of durable and reliable construction.

An even further object of the present invention is to provide a new and improved outdoor faucet organizing basket which is susceptible of a low cost of manufacture with regard to both materials and labor, and which accordingly is then susceptible of low prices of sale to the consuming public, thereby making such a outdoor faucet organizing basket economically available to the buying public.

Still yet another object of the present invention is to provide a new and improved outdoor faucet organizing basket which provides in the apparatuses and methods of the prior art some of the advantages thereof, while simultaneously overcoming some of the disadvantages normally associated therewith.

Even still another object of the present invention is to provide a new and improved outdoor faucet organizing basket for holding miscellaneous outdoor gardening tools at a location for their ready use.

Lastly, it is an object of the present invention to provide a new and improved outdoor faucet organizing basket comprising a container having a generally rectangular horizontal bottom wall with a border piece coupled thereto and extended upwards therefrom to create a hollow interior, the bottom wall having a planar top surface, a planar bottom surface, and a periphery interconnecting the surfaces formed of a front edge, a rear edge, and a pair of opposed side edges, the bottom wall further having an arrangement of spaced circular through holes formed thereon and with each through hole centrally aligned about a horizontal axis passing through the arrangement and with the horizontal axis positioned in perpendicular alignment with the front edge, and the border piece including an upstanding short front wall coupled the bottom wall at a location adjacent to and inwardly offset from the arrangement of through holes, an upstanding tall rear wall coupled to the bottom wall at a location adjacent to its rear edge, a pair of opposed parallel spaced upstanding side walls with each side wall coupled to the bottom wall at a location adjacent to one of its side edges, and a sequence of slots formed on each wall for allowing the interior to be ventilated and drained; coupling means for coupling the container to a nozzle of an outdoor faucet; a hose clamp for holding a hose coupled one of the side walls of the container; and a plurality of hooks coupled to the container for holding miscellaneous outdoor gardening tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
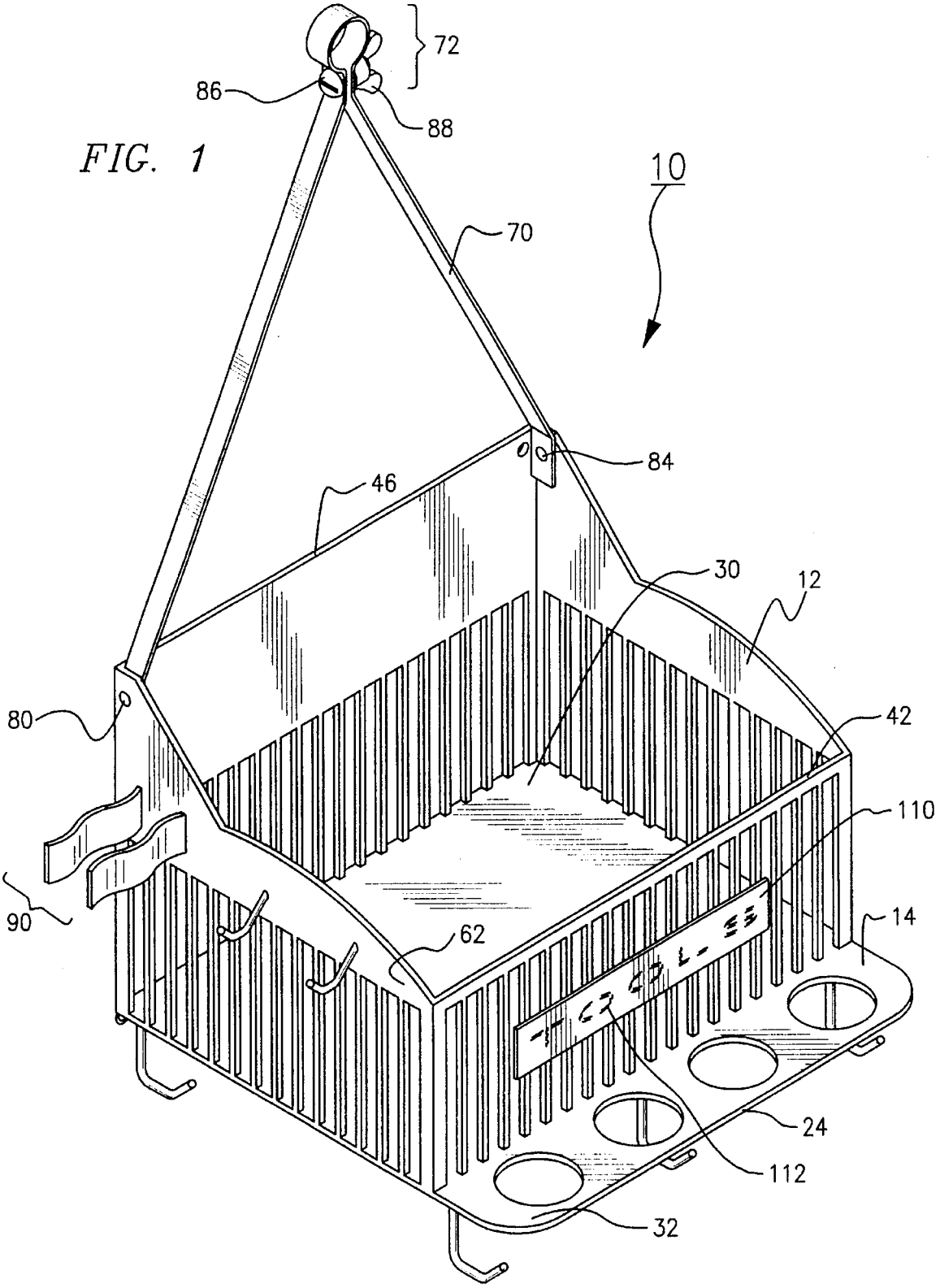
FIG. 1 is a perspective view of the preferred embodiment constructed in accordance with the principles of the present invention.
Figure 2:
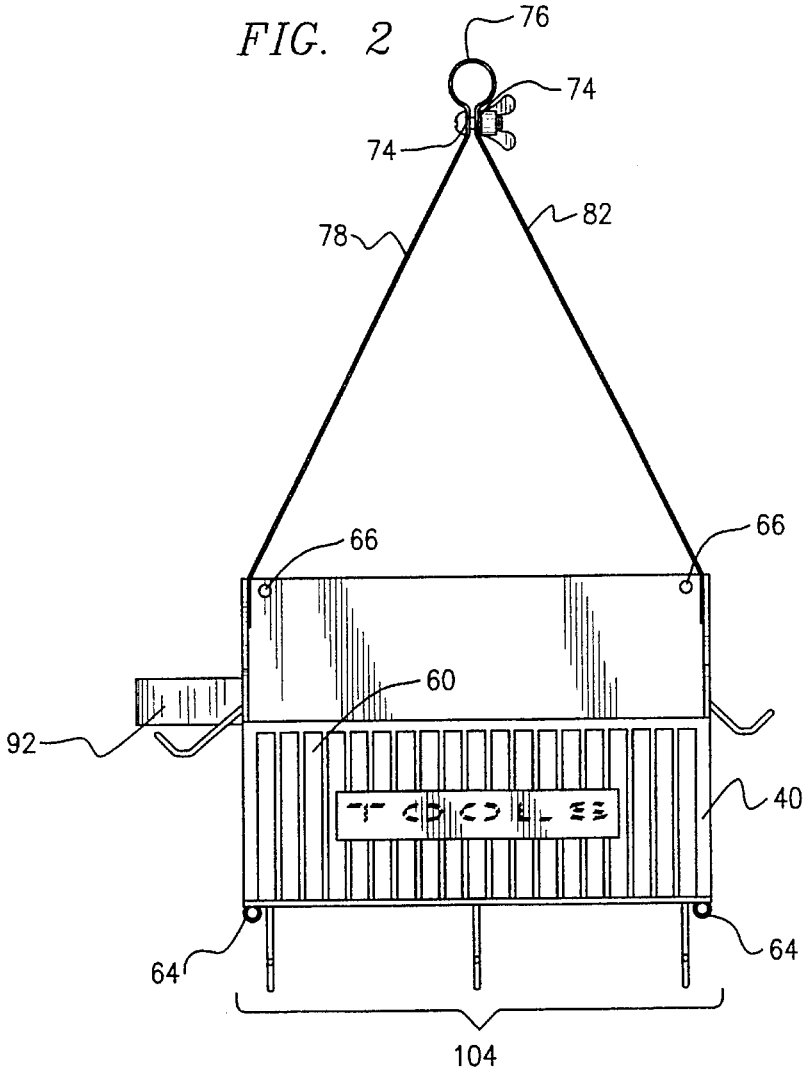
FIG. 2 is a front view of the preferred embodiment of the present invention.
Figure 3:
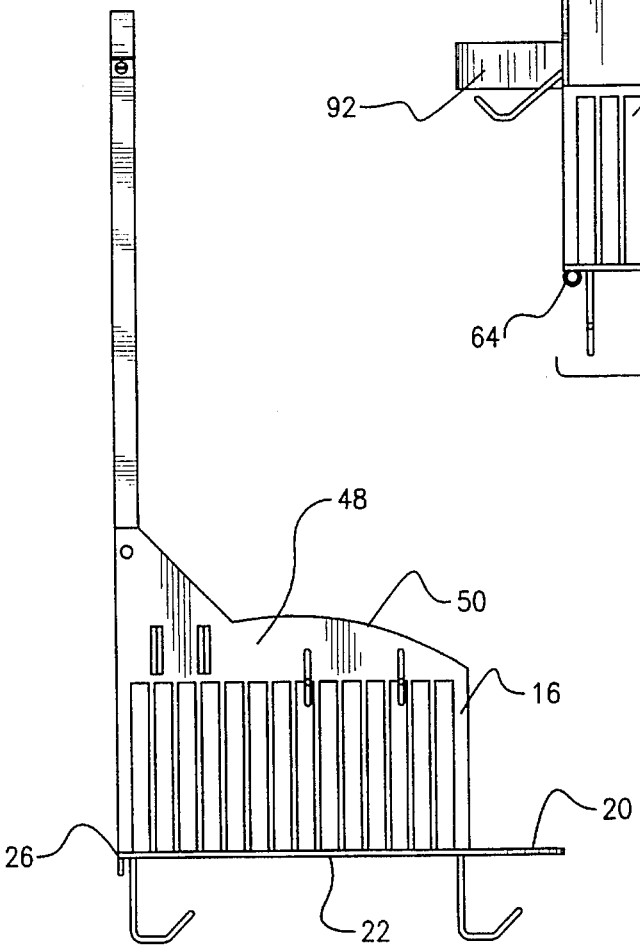
FIG. 3 is a side view of the preferred embodiment of the present invention.
Figure 4:
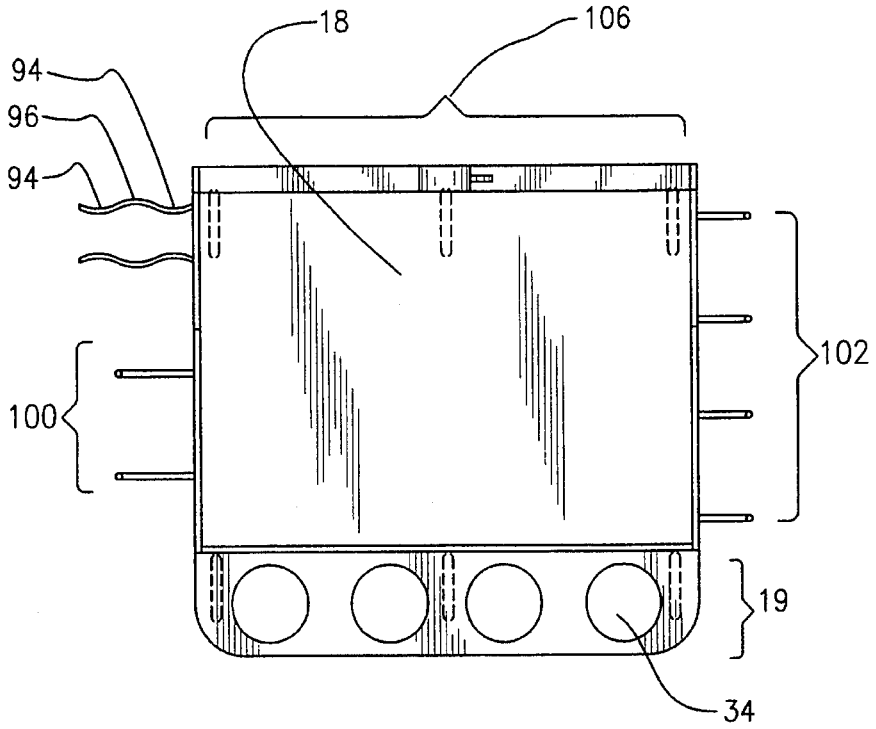
FIG. 4 is a plan view of the preferred embodiment of the present invention.
Figure 5:
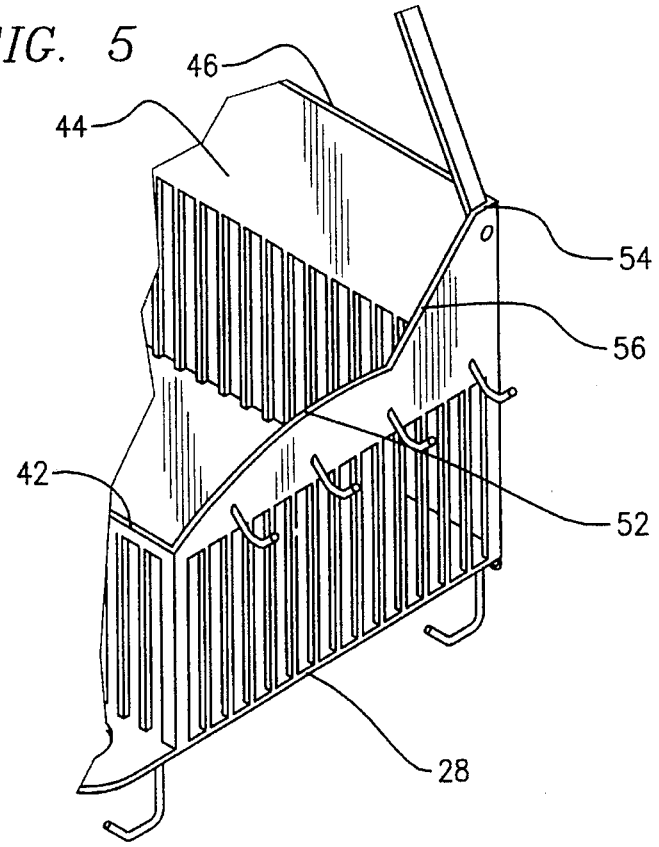
FIG. 5 is a fragmentary perspective view of a portion of the container of the present invention.

With reference now to the drawings, and in particular, to FIG. 1 thereof, the preferred embodiment of the new and improved outdoor faucet organizing basket embodying the principles and concepts of the present invention and generally designated by the reference number 10 will be described.

The preferred embodiment of the present invention comprises a plurality of components. In their broadest context, such components include a container, bracket, hose clamp, hooks and name plate. Such components are individually configured and correlated with respect to each other to provide a structure that is used for holding miscellaneous outdoor gardening tools at a location proximal to an outdoor faucet to allow for their ready access and use.

Specifically, the present invention includes a container 12. The container has a generally rectangular horizontal bottom wall 14. In addition, a border piece 16 is coupled to the bottom wall 14 and extended upwards therefrom to create a hollow interior 18 with a generally rectangular vertical cross-section and a rectangular opening for allowing access to the interior. The positioning of the border piece 16 on the bottom wall also create a frontal overhang portion 19.

The bottom wall 14of the container 12 has a planar top surface 20, a planar bottom surface 22, and a periphery interconnecting the surfaces. The periphery is formed of a front edge 24, a rear edge 26, and a pair of opposed side edges 28 interconnected between the edges 24, 26 to create a pair of squared-off rear corners 30 and a pair of rounded front corners 32. The bottom wall further has an arrangement of four spaced and circular through holes 34 formed on the overhang portion 19. Each through hole is centrally aligned about a horizontal axis that passes through the arrangement. The through holes are used for receiving and holding outdoor gardening tools like a hand-sprinkler or small shovel. The horizontal axis that extends through the holes 34 is positioned in parallel alignment with the front edge 24 of the bottom wall 14.

The border piece 16 of the present invention includes a vertically positioned and rectangular short front wall 40 coupled to the bottom wall 14 at a location adjacent to and inwardly offset from the arrangement of through holes 34. An upper extent of the front wall 40 is terminated at a horizontal straight top edge 42. The border piece also includes a vertically positioned rectangular tall rear wall 44 coupled to the bottom wall 14 at a location adjacent to its rear edge 26. An upper extent of the rear wall is terminated at a horizontal straight top edge 46. In addition, the border piece includes a pair of opposed, parallel, spaced, and vertically positioned side walls 48. Each side wall is coupled to the bottom wall 14 at a location adjacent to one of its side edges 28. An upper extent of each side wall is terminated at a top edge 50. The top edge has a lower curved front edge portion 52 connected with the front edge 42 of the front wall, an upper horizontal rear edge portion 54 connected with the top edge 46 of the rear wall, and an angled intermediate portion 56 interconnecting the front and rear edge portions 52, 54.

A sequence of vertically positioned and rectangular slots 60 are formed on and around the border piece 16 such that the border piece and bottom wall 14 in combination define a basket. The slots allow the interior of the container 12 to be ventilated and drained when wet gardening tools or other items are held therein. Each slot has a vertically extending length dimension and a transverse width dimension. Each slot has a lower portion extended all the way to the top surface 20 of the bottom wall and an upper portion terminated at an intermediate location on each wall to create a peripheral trim section 62. Trim section 32 is extended around an upper extent of the border piece 16. Coupled to and extended downwards from the bottom wall of the container is a pair of eyelets 64. Furthermore, a pair of spaced and circular through holes 66 are disposed on each upper extent of the rear wall 44 of the container near a separate side wall. Each eyelet and through hole has a size for receiving a fastener for securing the container 12 to a generally vertically exterior surface such as a wall of a building.

A generally inverted and V-shaped bracket 70 is provided. The bracket has a central ring portion 72 that is offset above a midpoint of the top edge 46 of the rear wall of the container. The ring portion is formed of a pair of opposed and flat pieces 74 with a generally circular loop 76 extended therebetween. The loop is disposable about an unillustrated nozzle of an outdoor faucet. The bracket also includes a first leg 78 that is extended angularly downwards from one of the pieces 74 of the ring portion and coupled to the upper extent of one of the side walls 48 of the border piece 16 at a location near the rear wall 44 with a rivet 80. A second leg 82 is extended angularly downwards from the other piece of the ring portion and coupled to the upper extent of the other side wall at a location near the rear wall with another rivet 84. An angle or between about 60–70 degrees is created between the legs. Lastly, a tightenable fastener formed of a threaded bolt 86 and complementary wing nut 88 is extended through a hole formed on each piece of the ring portion. The fastener is used for clamping the pieces together to secure the loop 76 to the nozzle of the faucet.

A hose clamp 90 is provided for holding a hose. The hose clamp is coupled to one of the side walls 48 of the container at a location adjacent to the rear wall 44. The hose clamp is formed of a pair of opposed, spaced, and elongated gripping members 92. Each gripping member has a pair of outer bends 94 formed thereon with an inner bend 96 formed therebetween.

A plurality of hooks is used in conjunction with the present invention for hanging miscellaneous gardening tools and related items. A first set 100 of two aligned and spaced hooks are coupled to and extended outwards from the same side wall of the container at the hose clamp 90 at a location near the front edge portion 52. A second set 102 of four aligned and spaced hooks are coupled to and extended outwards from the other side wall at a location near the top edge 50. A third set 104 of three aligned and spaced hooks are coupled to and extended downwards from the bottom wall 14 of the container at a location near the front edge 24. Lastly, a fourth set 106 of three aligned and spaced hooks are coupled to and extended downwards from the bottom wall 14 at a location near the rear edge 26. For identification purposes, a rectangular planar name plate 110 is coupled to the front wall of the container. The name plate bears identifying indicia 112 that could be used to describe the contents of the container or designate its owner. Preferably, the present invention is formed of a rigid steel or similar metal that is coated with plastic. In another embodiment, the present invention can be formed of a molded rigid impact-resistant plastic.

What has been described is a hanging basket that hangs from an outdoor faucet to keep garden hose nozzles and other miscellaneous tools in one place. The present invention keeps users from losing gardening tools while working in a yard. In the preferred embodiment, the container of the present invention has a width of about 5 inches, a length of about 3 inches, and a depth of about 1-½ inches as measured from the top edge of the front wall to the upper surface of the bottom wall.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An outdoor faucet organizing basket comprising:

a container having a generally rectangular horizontal bottom wall with a border piece coupled thereto and extended upwards therefrom to create a hollow interior, the bottom wall having a planar top surface, a planar bottom surface, and a periphery interconnecting the surfaces formed of a front edge, a rear edge, and a pair of opposed side edges, the bottom wall further having an arrangement of spaced circular through holes formed thereon, and the border piece including an upstanding short front wall, having a front edge, coupled to the bottom wall at a location adjacent to and inwardly offset from the arrangement of through holes, an upstanding tall rear wall having a top edge coupled to the bottom wall at a location adjacent to its rear edge, a pair of opposed parallel spaced upstanding side walls with each side wall coupled to the bottom wall at a location adjacent to one of its side edges, and a sequence of slots formed on each wall for allowing the interior to be ventilated and drained, and wherein an upper extent of each side wall of the container is terminated at a top edge having a lower curved front edge portion connected with the front edge of the front wall, an upper horizontal rear edge portion connected with the top edge of the rear wall, and an angled intermediate portion interconnecting the front and rear edge portions;

first coupling means for receiving a plurality of fasteners for securing the container to a generally vertical exterior surface;

coupling means secured to and extended upwards from the container for coupling the container to a nozzle of an outdoor faucet;

a hose clamp coupled to one of the side walls of the container; and a plurality of hooks coupled to the container and projecting outwards therefrom for holding miscellaneous outdoor gardening tools.

2. An outdoor faucet organizing basket for holding miscellaneous outdoor gardening tools at a location for their ready use comprising, in combination:

a container having a generally rectangular horizontal bottom wall with a border piece coupled thereto and extended upwards therefrom to create a hollow interior with a generally rectangular vertical cross section, the bottom wall having a planar top surface, a planar bottom surface, and a periphery interconnecting the surfaces formed of a front edge, a rear edge, and a pair of opposed side edges interconnected between the edges to create a pair of squared-off rear corners and a pair of rounded front corners, the bottom wall further having a linear arrangement of four spaced and circular through holes formed thereon and with the arrangement positioned in parallel alignment with the front edge, the border piece including a vertically positioned short front wall coupled to the bottom wall at a location adjacent to and inwardly offset from the arrangement of through holes and with an upper extent of the front wall terminated at a horizontal top edge, a vertically positioned tall rear wall coupled to the bottom wall at a location adjacent to its rear edge and with an upper extent of the rear wall terminated at a horizontal top edge, and a pair of opposed parallel spaced vertically positioned side walls with each side wall coupled to the bottom wall at a location adjacent to one of its side edges and with an upper extent of each side wall terminated at a top edge having a lower curved front edge portion connected with the front edge of the front wall, an upper horizontal rear edge portion connected with the top edge of the rear wall, and an angled intermediate portion interconnecting the front and rear edge portions, the border piece further including a sequence of vertically positioned rectangular slots formed thereon for allowing the interior to be ventilated, a pair of eyelets coupled to and extended downwards from the bottom wall of the container, and a pair of spaced through holes disposed on the upper extent of the rear wall of the container and with each eyelet and through hole of the rear wall having a size for receiving a fastener for securing the container to a generally vertical exterior surface;

a generally inverted V-shaped bracket having a central ring portion offset above a midpoint of the top edge of the rear wall of the container and with the ring portion formed of pair of opposed flat pieces with a loop extended therebetween and disposable about a nozzle of an outdoor faucet, the bracket further having a first leg extended angularly downwards from one of the pieces of the ring portion and coupled to the upper extent of one of the side walls of the border piece at a location near the rear wall, a second leg extended angularly downwards from the other piece of the ring portion and coupled to the upper extent of the other side wall of the container at a location near the rear wall, and a tightenable fastener extended through the pieces of the ring portion for clamping the pieces together to secure the loop to the nozzle of the faucet;

a hose clamp coupled to one of the side walls of the container at a location adjacent to the rear wall, the clamp formed of a pair of opposed spaced elongated gripping members with each member having a pair of outer bends formed thereon with an inner bend formed therebetween;

a first set of two aligned and spaced hooks coupled to and extended outwards from the same side wall of the container as the hose clamp at a location near the front edge portion thereof;

a second set of four aligned and spaced hooks coupled to and extended outwards from the other side wall at a location near the top edge thereof;

a third set of three aligned and spaced hooks coupled to and extended downwards from the bottom wall at a location near the front edge thereof;

a fourth set of three aligned and spaced hooks coupled to and extended downwards from the bottom wall at a location near the rear edge thereof; and a rectangular planar name plate coupled to the front wall and bearing identifying indicia, and wherein the outdoor faucet organizing basket is formed of a rigid metal coated with plastic.

3. An outdoor faucet organizing basket comprising:

a container having a generally rectangular horizontal bottom wall with a border piece coupled thereto and extended upwards therefrom to create a hollow interior, the bottom wall having a planar top surface, a planar bottom surface, and a periphery interconnecting the surfaces formed of a front edge, a rear edge, and a pair of opposed side edges, the bottom wall further having an arrangement of spaced circular through holes formed thereon and with each through hole centrally aligned about a horizontal axis passing through the arrangement and with the horizontal axis positioned in parallel alignment with the front edge, and the border piece including an upstanding short front wall coupled the bottom wall at a location adjacent to and inwardly offset from the arrangement of through holes, an upstanding tall rear wall coupled to the bottom wall at a location adjacent to its rear edge, a pair of opposed parallel spaced upstanding side walls with each side wall coupled to the bottom wall at a location adjacent to one of its side edges, and a sequence of slots formed on each wall for allowing the interior to be ventilated and drained;

a generally V-shaped bracket having a central ring portion offset above the rear wall of the container and with the ring portion formed of pair of opposed flat pieces with a loop extended therebetween and disposable about the nozzle of the outdoor faucet, the bracket further having a first leg extended angularly downwards from one of the pieces of the ring portion and coupled to an upper extent of one of the side walls, a second leg extended angularly downwards from the other piece of the ring portion and coupled to an upper extent of the other side wall, and a tightenable fastener extended through the pieces of the ring portion for clamping the pieces together to secure the loop to the nozzle of the faucet;

a hose clamp coupled to one of the side walls of the container; and a plurality of hooks coupled to the container for holding miscellaneous outdoor gardening tools.

* * * * *